US010827254B2

(12) United States Patent
Kim

(10) Patent No.: US 10,827,254 B2
(45) Date of Patent: Nov. 3, 2020

(54) PASSIVE RADIATOR VIBRATION SPEAKER HAVING PHASE REVERSAL STRUCTURE

(71) Applicants: Hyundai Motor Company, Seoul (KR); Kia Motors Corporation, Seoul (KR)

(72) Inventor: Youngbeom Kim, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/564,865

(22) Filed: Sep. 9, 2019

(65) Prior Publication Data

US 2020/0322716 A1 Oct. 8, 2020

(30) Foreign Application Priority Data

Apr. 8, 2019 (KR) ..... 10-2019-0040724

(51) Int. Cl.

| | |
|---|---|
| ***H04R 1/28*** | (2006.01) |
| ***H04R 9/06*** | (2006.01) |
| ***H04R 3/00*** | (2006.01) |
| ***H04R 9/04*** | (2006.01) |

(52) U.S. Cl.

CPC ..... *H04R 1/2834* (2013.01); *H04R 3/00* (2013.01); *H04R 9/043* (2013.01); *H04R 9/06* (2013.01)

(58) Field of Classification Search

CPC ..... H04R 1/283; H04R 1/2834; H04R 3/00; H04R 9/043; H04R 9/06; H04R 7/04; H04R 7/12; H04R 7/14; H04R 7/26

See application file for complete search history.

(56) References Cited

U.S. PATENT DOCUMENTS

| | | | | |
|---|---|---|---|---|
| 2010/0135516 | A1* | 6/2010 | Saiki | H04R 1/2811 381/386 |
| 2012/0114148 | A1* | 5/2012 | Goh Kong San | H04R 1/2834 381/186 |
| 2014/0029782 | A1* | 1/2014 | Rayner | H04R 3/00 381/386 |
| 2015/0281844 | A1* | 10/2015 | Stabile | H04R 7/00 381/345 |
| 2017/0013352 | A1* | 1/2017 | Shihuang | H04R 1/323 |
| 2018/0063610 | A1* | 3/2018 | Tanabe | H04R 1/023 |
| 2018/0176677 | A1* | 6/2018 | Tanabe | H04R 1/028 |
| 2020/0128319 | A1* | 4/2020 | Liao | H04R 9/04 |

* cited by examiner

*Primary Examiner* — Jason R Kurr

(74) *Attorney, Agent, or Firm* — Mintz Levin Cohn Ferris Glovsky and Popeo, P.C.; Peter F. Corless

(57) ABSTRACT

A passive radiator vibration speaker having a phase reversal structure can include a driving unit configured to generate a driving force, a diaphragm f disposed on an upper side of the driving unit to reproduce a first sound of a sound band of a specific range by being vibrated by the driving unit, a passive radiator disposed above the diaphragm in a state of being spaced apart from the diaphragm by a determined distance to reproduce a second sound of a relatively lower sound band than that of the diaphragm through vibration, and a phase reversal unit having one side being in contact with a lower surface of the diaphragm to reverse a phase of a part of the vibration of the diaphragm so as to transmit a phase-reversed vibration to the passive radiator, where the phase-reversed vibration is in a reversed phase to the vibration of the diaphragm.

8 Claims, 4 Drawing Sheets

PASSIVE RADIATOR VIBRATION SPEAKER HAVING PHASE REVERSAL STRUCTURE

CROSS-REFERENCE TO RELATED APPLICATION(S)

This application claims under 35 U.S.C. § 119 the benefit of Korean Patent Application No. 10-2019-0040724, filed on Apr. 8, 2019 in the Korean Intellectual Property Office, the entire contents of which are incorporated by reference herein.

BACKGROUND

1. Technical Field

The present disclosure relates to a passive radiator vibration speaker having a phase reversal structure, more particularly, to the passive radiator vibration speaker configured to solve the problem of low sound output of a conventional vibration speaker by applying a passive radiator and the problem of sound pressure attenuation according to a phase of the passive radiator through the phase reversal structure.

2. Description of the Related Art

In general, a speaker is an electroacoustic conversion element. Recent development of video devices, communication devices, and the like has resulted in further research being conducted on speakers that are more suitable for the video devices, the communication devices, and the like and capable of outputting high quality sound signals.

A moving coil type speaker which directly vibrates air by vibrating a diaphragm is mainly used as a typical speaker.

FIG. 1 (RELATED ART) is a view illustrating a conventional moving coil type speaker.

As shown in FIG. 1, in a conventional moving coil type speaker, permanent magnets 101 are configured to be formed in a ring shape, and a front plate 103 and a back plate 105 are disposed on an upper side and a lower side of the permanent magnets 101, respectively, thereby constituting a magnetic circuit together with a pole piece 107. A predetermined gap is formed between the pole piece 107 and the front plate 103. A voice coil 109 wound around a bobbin is disposed in the gap, and a spider 111 is provided to support the voice coil 109.

A diaphragm 113 is attached to the bobbin in order to widen a vibration area to increase acoustic output. The diaphragm 113 is supported by an edge of a speaker frame 119, that is, a surround 115 having a flexible material.

The moving coil type speaker uses a principle (moving coil type) in which the voice coil 109 is moved up and down by a force proportional to the magnetic flux of the permanent magnets 101, the amount of current flowing through the voice coil 109, and the number of turns of the voice coil 109, which is generated by flowing a current through the voice coil 109 installed in a narrow gap between the permanent magnets 101 composed of N poles and S poles (accordingly, the voice coil is referred to as a moving coil) and kinetic energy generated by the up and down movement of the voice coil 109 is transmitted to the diaphragm 113 to vibrate air on a front surface of the diaphragm 113, thereby generating sound. That is, the moving coil type speaker uses a principle in which a force generated by an interaction between the direct magnetic flux by the permanent magnets 101 and the alternating magnetic flux by the voice coil 109 causes the voice coil 109 to move up and down and a force generated by the up and down movement of the voice coil 109 is transmitted to the diaphragm 113 to vibrate air on the front surface of the diaphragm 113, thereby generating sound.

As such, because the moving coil type speaker has a structure in which the voice coil 109 and the diaphragm 113 move together, the weight of a vibration system is increased, so that the sound reproduction in a high frequency band is limited and the overall sound output efficiency of the speaker is lowered.

Further, in the moving coil type speaker, divided vibration occurs in which one portion of the diaphragm 113 bonded to the voice coil 109 and one portion of the diaphragm 113 not bonded to the voice coil 109 vibrate differently, so that the sound quality in a high frequency band is lowered and the acoustic output is reduced.

Further, in the moving coil type speaker, due to the up and down movement of the diaphragm 113, disconnection of wires on the bonded portion of the voice coil 109 is generated, so that noise is generated from the diaphragm 113 and the wires.

Further, because the diaphragm 113 is located above the permanent magnets 101 and the total thickness of the speaker is determined by the sum of the height of the permanent magnets 101 and the height of the diaphragm 113, the moving coil type speaker may not be sufficiently thin.

In addition, the moving coil type speaker has problems in that the overall size of the speaker is increased by the diaphragm 113 and a dust cap 117, and the sound pressure of the speaker is reduced by the limitation of the vibration area due to the increase in size.

In order to solve these problems, research has been conducted into reducing the weight of the vibration system of a speaker, and an example of such a speaker is a vibration speaker in which a driving part of a speaker is directly in contact with an outer panel, and the outer panel is used as a vibration surface.

However, because the panel of the vibration speaker is mainly made of plastic or steel, the panel has a relatively large elasticity (K, stiffness) as compared with the vibrating plate of the moving coil type speaker made of a paper material, and therefore the resonance frequency of the speaker is increased, which causes a problem that low sound output of the speaker becomes difficult.

SUMMARY

It is an aspect of the present disclosure to provide a passive radiator vibration speaker having a phase reversal structure capable of improving sound quality such as reinforcement of low sound output by applying a passive radiator, and capable of solving a problem of sound pressure attenuation according to the phase of the passive radiator by applying the phase reversal structure.

In accordance with an aspect of the present disclosure, a passive radiator vibration speaker having a phase reversal structure includes a driving unit configured to generate a driving force, a diaphragm (e.g., formed in a plate shape) disposed on an upper side of the driving unit, the diaphragm configured to produce a vibration by being vibrated by the driving unit so as to reproduce a first sound of a sound hand of a specific range, a passive radiator (e.g., formed in a plate shape) disposed above the diaphragm in a state of being spaced apart from the diaphragm by a determined distance to reproduce a second sound of a relatively lower sound band than that of the diaphragm through vibration, and a phase reversal unit having one side being in contact with a lower surface of the diaphragm to reverse a phase of a part of the vibration of the diaphragm so as to transmit a phase-reversed vibration to the passive radiator, wherein the phase-reversed vibration is in a reversed phase to the vibration of the diaphragm.

The driving unit may be formed in a cylindrical shape, and the passive radiator may be formed in a circular plate shape having a diameter larger than that of the driving unit.

The phase reversal unit may include a first reversal member extending in a direction from an edge of the passive radiator toward a lower side thereof to penetrate one side of the diaphragm, a second reversal member extending in a direction from one end of the first reversal member toward the driving unit, and a third reversal member extending in a direction from one end of the second reversal member toward the diaphragm 300 to come into contact with a lower surface of the diaphragm.

The passive radiator vibration speaker may further include an amplifier provided to be in contact with the lower surface of the diaphragm and an upper surface of the second reversal member to increase an amplitude of vibration of the diaphragm.

The amplifier may be tapered to have a narrower width in a direction from the lower surface of the diaphragm toward the second reversal member.

The passive radiator vibration speaker may further include a discharge hole formed to penetrate one region of the diaphragm between the third reversal member and the driving unit so as to discharge air in a space between the passive radiator and the diaphragm.

The diaphragm include a spider formed at one region adjacent to the first reversal member passing through the diaphragm to fix the first r member.

The spider may be formed in a zigzag shape having valleys and peaks, and the first reversal member may be fixed to a specific valley of the spider.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Figure 1:
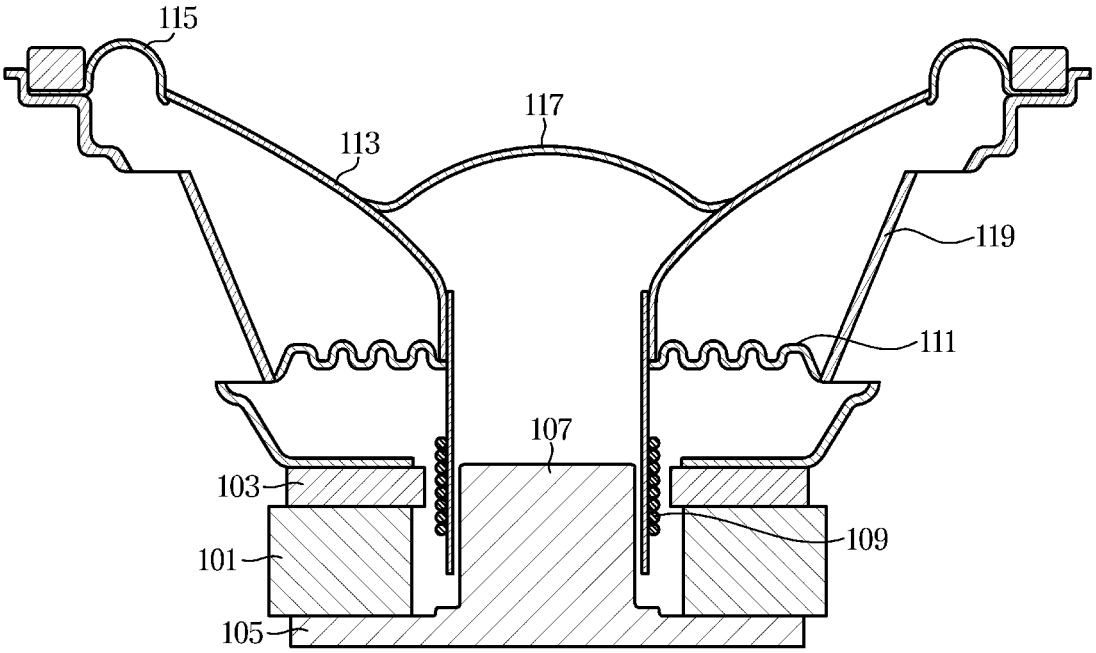
FIG. 1 (RELATED ART)
FIG. 1 (RELATED ART) is a view illustrating a conventional moving coil type speaker.

It is understood that the term "vehicle" or "vehicular" or other similar term as used herein s inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms well, less the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable is stored and executed in a distributed fashion, e.g., by a telematics server or a Controller Area Network (CAN).

The embodiments described herein and the configurations shown in the drawings are only examples of preferred embodiments of the present disclosure, and various modifications may be made at the time of filing of the present disclosure to replace the embodiments and drawings of the present specification.

Like reference numbers or designations in the various figures of the present application represent parts or components that perform substantially the same functions.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component.

Hereinafter, embodiments of the present disclosure will be described in detail with reference to the accompanying drawings.

Figure 2:
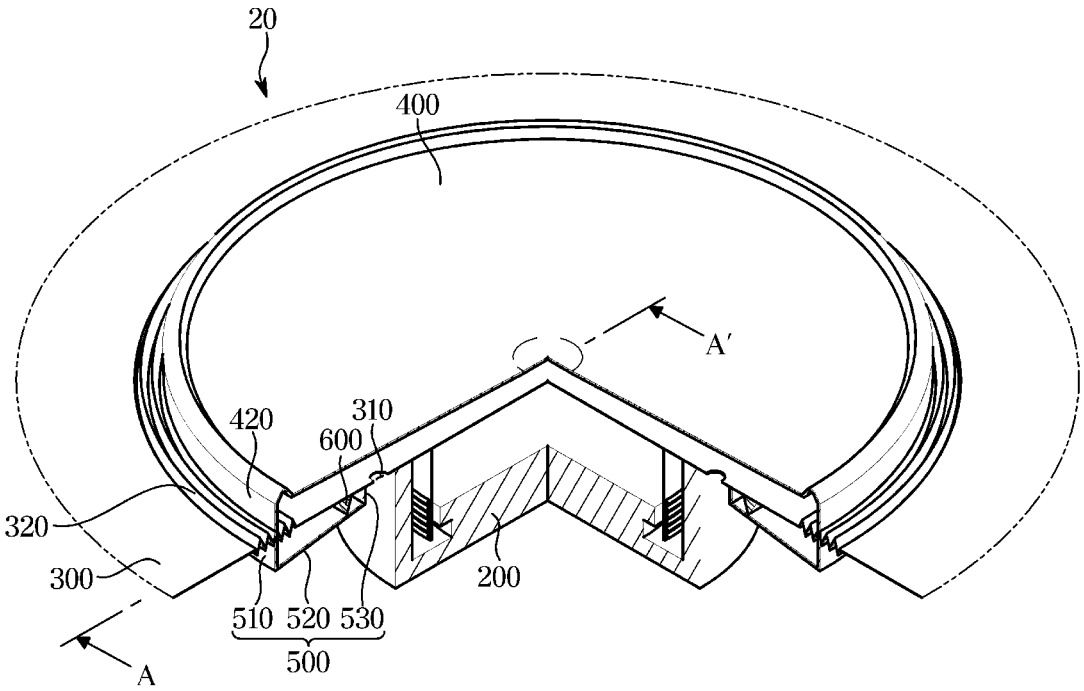
FIG. 2 is a partial cutaway perspective view illustrating a passive radiator vibration speaker having a phase reversal structure according to an embodiment of the present disclosure.
Figure 3:
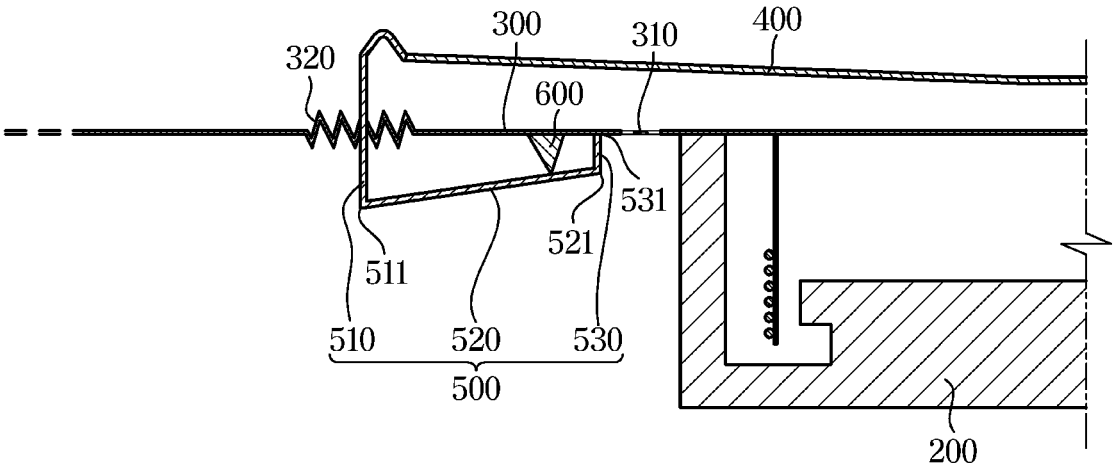
FIG. 3 is a cross-sectional view of the passive radiator vibration speaker having the phase reversal structure, which is taken along line A-A' in FIG. 2.

FIG. 2 is a partial cutaway perspective view illustrating a passive radiator vibration speaker having a phase reversal structure according to an embodiment of the present disclosure, and FIG. 3 is a cross-sectional view of the passive radiator vibration speaker having the phase reversal structure, which is taken along line A-A' in FIG. 2.

Referring to FIGS. 2 and 3, a passive radiator vibration speaker 20 having a phase reversal structure using a jig and a motor according to an embodiment of the present disclosure includes a driving unit 200, a diaphragm 300, a passive radiator 400, a phase reversal unit 500, and an amplifier 600.

The driving unit 200 is provided for generating a driving force to vibrate the diaphragm 300, which will be described later, and may include a yoke, a magnet, a voice coil, a suspension, and the like, which are included in a conventional vibration speaker.

The driving unit 200 may have a cylindrical shape.

The diaphragm 300 preferably is formed in a plate shape and is disposed on an upper side of the driving unit 200 to be vibrated by the driving unit 200. The diaphragm 300 vibrates up and down to perform piston vibration as a whole, thereby emitting sound waves to reproduce sound of a specific range hand.

The diaphragm 300 may extend to have a larger size than the passive radiator 400 positioned thereon as shown in FIG. 2. When the driving unit 200 is formed in a cylindrical shape, the diaphragm 300 may be formed in a circular plate shape having a diameter larger than that of the driving unit 200.

The passive radiator 400 preferably is formed in a plate shape and positioned above the diaphragm 300. As one side of the passive radiator 400 is in contact with a lower surface of the diaphragm 300, when the diaphragm 300 vibrates, the passive radiator 400 may receive a part of the vibration of the diaphragm 300 and vibrate, and may reproduce sound (i.e., a second sound) of a relatively lower hand than the diaphragm 300 through the vibration.

That is, the passive radiator 400 is also referred to as an auxiliary bass radiator (ABR). Because the passive radiator 400 is a flat speaker unit without a voice coil or a magnetic structure, although the passive radiator 400 may not produce sound by itself, the passive radiator 400 may operate in response to the inner air pressure changed by the movement of the diaphragm 300, that is, use the resonance of a vibration system to reproduce and emit a low sound.

In this case, the passive radiator 400 may be formed in a circular plate shape having a diameter larger than that of the driving unit 200 and having a diameter smaller than that of the diaphragm 300.

As such, the passive radiator vibration speaker 20 having a phase reversal structure according to an embodiment of the present disclosure may reproduce a sound band of different ranges through the diaphragm 300 and the passive radiator 400. That is, the passive radiator vibration speaker 20 may reproduce a high-pitched sound and a middle-pitched sound through the diaphragm 300 and may reproduce a low-pitched sound through the passive radiator 400, thereby reproducing a sound band of a wide range.

The phase reversal unit 500 is formed to surround the driving unit 200 in a state of being spaced apart from the driving unit 200 by a predetermined distance at a lower side of the diaphragm 300. The phase reversal unit 500 may include a hollow portion to allow the driving unit 200 to be positioned in the center of the phase reversal unit 500 when the driving unit 200 is formed in a cylindrical shape.

The phase reversal unit 500 functions to reverse the phase of a part of the vibration of the diaphragm 300 and transmit the phase-reversed vibration to the passive radiator 400 when the diaphragm 300 vibrates. That is, because a problem of sound pressure attenuation of the speaker may occur when the vibration of the diaphragm 300 and the vibration of the passive radiator 400 are in the same phase, which will be described later, the phase reversal unit 500 functions to reverse the phase of the vibration transmitted to the passive radiator 400 so that the vibration of the passive radiator 400 and the vibration of the diaphragm 300 are in reversed phases to each other.

The phase reversal unit 500 includes a first reversal member 510, a second reversal member 520, and a third reversal member 530.

The first reversal member 510 extends to penetrate one side of the diaphragm 300 in a direction from an edge of the passive radiator 400 toward the diaphragm 300. The first reversal member 510 may form a predetermined height to support the passive radiator 400 on the diaphragm 300 and transmit the phase-reversed vibration to the passive radiator 400.

The second reversal member 520 extends in a direction from one end 511 of the first reversal member 510 toward the driving unit 200. In this case, the second reversal member 520 may extend parallel to the passive radiator 400 or may extend obliquely to form an inclination angle with respect to the horizontal direction.

The third reversal member 530 extends in a direction from one end 521 of the second reversal member 520 toward the diaphragm 300 to come into contact with the lower surface of the diaphragm 300. In this case, the third reversal member 530 is formed adjacent to the driving unit 200 and is formed around the driving unit 200 to surround the driving unit 200 in a state of being spaced apart from the driving unit 200 by a predetermined distance.

When the diaphragm 300 is vibrated by a driving force of the driving unit 200, as the end 531 of the third reversal member 530 is in contact with the lower surface of the diaphragm 300, a part of the vibration of the diaphragm 300 may be transmitted to the third reversal member 530, and the vibration transmitted to the third reversal member 530 is sequentially transmitted to the second reversal member 520 and the first reversal member 510 so that the phase of the vibration may be reversed.

That is, as a part of the vibration of the diaphragm 300 is sequentially transmitted to the third reversal member 530, the second reversal member 520, and the first reversal member 510, the part of the vibration is reversed to have a reversed phase to the vibration of the diaphragm 300 and is transmitted to the passive radiator 400, and the passive radiator 400 generates a sound wave by the reversed vibration and vibrates.

Thus, the passive radiator vibration speaker 20 having the phase reversal structure according to the present disclosure may reproduce a sound band of a wide range by reproducing sounds from the diaphragm 300 and the passive radiator 400, respectively, and at the same time, the vibration of the diaphragm 300 and the vibration of the passive radiator 400 form the reversed phases to each other so that a sound pressure attenuation phenomenon due to the interference of the respective vibrations is not generated.

The amplifier 600 may be provided between the lower surface of the diaphragm 300 and the second reversal member 520 of the phase reversal unit 500 so that a sound having a larger sound pressure than that of each of the diaphragm 300 and the passive radiator 400 described above may be reproduced.

That is, the amplifier 600 is provided to be in contact with the lower surface of the diaphragm 300 and an upper surface of the second reversal member 520 and may increase the amplitude of the vibration transmitted to the diaphragm 300 to increase the sound pressure of the diaphragm 300. The amplifier 600 may also increase the amplitude of the vibration transmitted from the diaphragm 300 to the phase reversal unit 500 to increase the sound pressure of the passive radiator 400.

The amplifier 600 may be tapered to have a narrower width from the lower surface of the diaphragm 300 toward the lower side, that is, toward the second reversal member 520. With this configuration, the amplitude of the vibration of the diaphragm 300 may be increased more effectively to be transmitted to the second reversal member 520.

As described above, the third reversal member 530 and the driving unit 200 are positioned below the diaphragm 300 in a state of being spaced apart from each other. In this case, a discharge hole 310 penetrating the diaphragm 300 may be formed on a portion of the diaphragm 300 between the third reversal member 530 and the driving unit 200.

As shown in FIG. 2, a space formed between the passive radiator 400 and the diaphragm 300 may be sealed by an edge portion 4:20 of the passive radiator 400. Accordingly, there is a problem in that a spring coefficient of the passive radiator 400 may increase due to the compression of the ambient air (i.e., the air in a space between the passive radiator 400 and the diaphragm 300) of the passive radiator 400 when the passive radiator 400 vibrates.

The discharge hole 310 is provided for preventing such a problem. That is, the discharge hole 310 is formed to penetrate the diaphragm 300 so that the air in the space between the passive radiator 400 and the diaphragm 300 may be discharged to the outside through the discharge hole 310, thereby preventing the spring coefficient of the passive radiator 400 from increasing.

The diaphragm 300 may include a spider 320 formed at one region adjacent to the first reversal member 510 penetrating the diaphragm 300 to fix the first reversal member 510.

The spider 320 is formed in a zigzag shape having valleys and peaks. The first reversal member 510 may be positioned at a specific valley of the spider 320 and penetrate the specific valley to be fixed by the spider 320.

Accordingly, the phase reversal unit 500 is stably fixed without swaying from side to side, so that the quality of the sound reproduced by the passive radiator 400 may be improved when the vibration is transmitted from the phase reversal unit 500 to the passive radiator 400.

Figure 4:
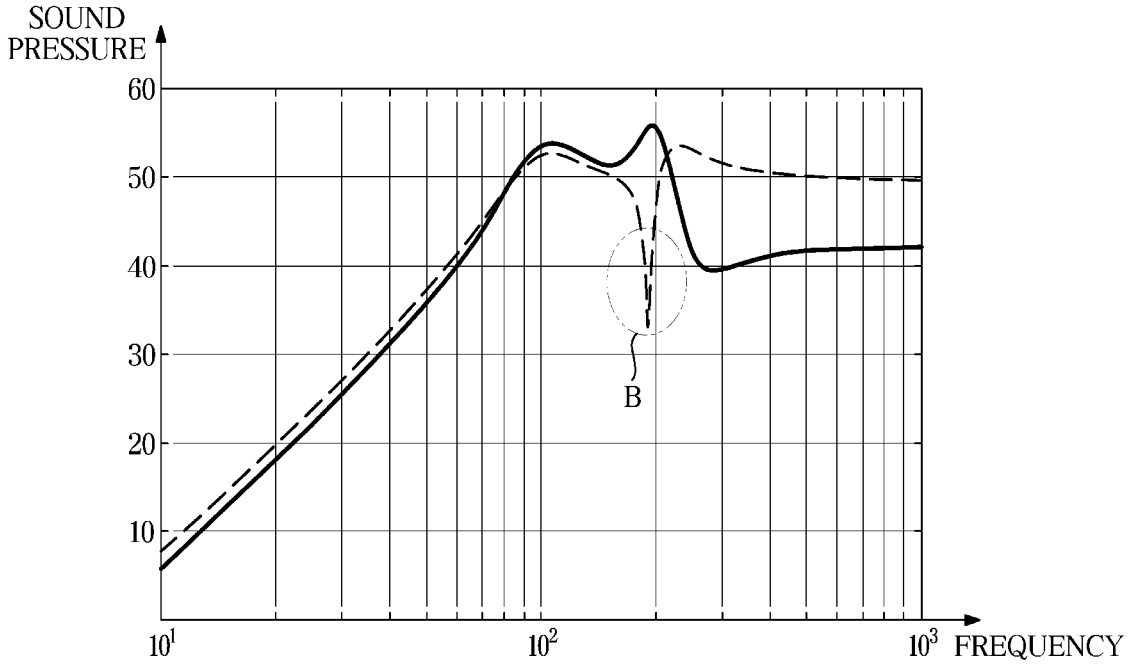
FIG. 4 is a graph showing changes in sound pressure according to frequencies of a speaker to which a conventional passive radiator is applied and the passive radiator vibration speaker having the phase reversal structure of FIG. 2.

FIG. 4 is a graph showing changes in sound pressure according to frequencies of a speaker to which a conventional passive radiator is applied and the passive radiator vibration speaker having the phase reversal structure of FIG. 2.

First, reviewing changes in sound pressure according to frequencies of a speaker to which a conventional passive radiator is applied with reference to FIG. 4, as shown by a dotted line, it may be seen that the low-pitched sound band is improved by applying the passive radiator, but there is a problem in that a dip phenomenon occurs in a 'B' portion.

That is, in the case of a speaker to which a conventional passive radiator is applied, it may be seen that the low-pitched sound band is improved by applying the passive radiator, but the vibration of the diaphragm and the vibration of the passive radiator form an in-phase with respect to each other, thereby occurring a dip phenomenon.

On the other hand, in the case of the passive radiator vibration speaker 20 having the phase reversal structure according to the present disclosure, as shown by a solid line, it may be seen that the low-pitched sound band is greatly improved and the dip phenomenon is eliminated by applying the passive radiator and forming the vibration of the diaphragm 300 and the vibration of the passive radiator 400 in reversed phases to each other, thereby improving the quality of the sound of the passive radiator vibration speaker 20 having the phase reversal structure.

As is apparent from the above, a passive radiator vibration speaker having a phase reversal structure according to the present disclosure can greatly improve the quality of the sound in a low-pitched sound band by including a passive radiator, and can prevent a dip phenomenon and prevent the sound pressure attenuation due to the dip phenomenon by forming the vibration of a diaphragm and the vibration of the passive radiator in the reversed phases to each other through a phase reversal unit.

Further, the passive radiator vibration speaker having the phase reversal structure according to the present disclosure can prevent a spring coefficient of the passive radiator from increasing as a discharge hole is formed on the diaphragm so as to complement the structure in which the passive radiator and the diaphragm are sealed with each other so that the air in a space between the passive radiator and the diaphragm is discharged to the outside through the discharge hole.

The scope of the present disclosure is not limited to the specific embodiments described above. It will be understood by those skilled in the art that various changes in form and details may be made therein without departing from the spirit and scope of t the present disclosure as defined by the appended claims.

What is claimed is:

1. A passive radiator vibration speaker having a phase reversal structure, comprising:

a driving unit configured to generate a driving force;

a diaphragm disposed on an upper side of the driving unit, the diaphragm configured to produce a vibration by being vibrated by the driving unit so as to reproduce a first sound of a sound band of a specific range;

a passive radiator disposed above the diaphragm in a state of being spaced apart from the diaphragm by a determined distance to reproduce a second sound of a relatively lower sound band than that of the diaphragm through vibration; and a phase reversal unit having one side being in contact with a lower surface of the diaphragm to reverse a phase of a part of the vibration of the diaphragm so as to transmit a phase-reversed vibration to the passive radiator, wherein the phase-reversed vibration is in a reversed phase to the vibration of the diaphragm.

2. The passive radiator vibration speaker according to claim 1, wherein:

the driving unit is formed in a cylindrical shape, and the passive radiator is formed in a circular plate shape having a diameter larger than that of the driving unit.

3. The passive radiator vibration speaker according to claim 2, wherein the phase reversal unit includes:

a first reversal member extending in a direction from an edge of the passive radiator toward a lower side thereof to penetrate one side of the diaphragm;

a second reversal member extending in a direction from one end of the first reversal member toward the driving unit; and a third reversal member extending in a direction from one end of the second reversal member toward the diaphragm to come into contact with the lower surface of the diaphragm.

4. The passive radiator vibration speaker according to claim 3, further comprising:

an amplifier provided to be in contact with the lower surface of the diaphragm and an upper surface of the second reversal member to increase an amplitude of vibration of the diaphragm.

5. The passive radiator vibration speaker according to claim 4, wherein:

the amplifier is tapered to have a narrower width in a direction from the lower surface of the diaphragm toward the second reversal member.

6. The passive radiator vibration speaker according to claim 3, further comprising:

a discharge hole formed to penetrate one region of the diaphragm between the third reversal member and the diving unit so as to discharge air in a space between the passive radiator and the diaphragm.

7. The passive radiator vibration speaker according to claim 3, wherein:

the diaphragm includes a spider formed at one region adjacent to the first reversal member passing through the diaphragm to fix the first reversal member.

8. The passive radiator vibration speaker according to claim 7, wherein:

the spider is formed in a zigzag shape having valleys and peaks, and the first reversal member is fixed to a specific valley of the spider.

* * * * *